US007000988B2

(12) United States Patent
Bressler et al.

(10) Patent No.: US 7,000,988 B2
(45) Date of Patent: Feb. 21, 2006

(54) LIFT CHAIR

(75) Inventors: Peter W. Bressler, Philadelphia, PA (US); Andrew Weiman, Langhorne, PA (US)

(73) Assignee: Universal Product Development Company, LLC, Philadelphia, PA (US)

( * ) Notice: Subject to any disclaimer, the term of this patent is extended or adjusted under 35 U.S.C. 154(b) by 203 days.

(21) Appl. No.: 10/639,704

(22) Filed: Aug. 12, 2003

(65) Prior Publication Data

US 2005/0046255 A1 Mar. 3, 2005

(51) Int. Cl.
*A61G 15/00* (2006.01)

(52) U.S. Cl. ..... 297/325; 297/326; 297/313; 297/DIG. 10; 297/344.16

(58) Field of Classification Search ..... 297/DIG. 10, 297/313, 325, 326, 337, 338, 344.15, 344.16, 297/339

See application file for complete search history.

(56) References Cited

U.S. PATENT DOCUMENTS

| | | | | |
|---|---|---|---|---|
| 974,769 | A | | 11/1910 | Hoff |
| 1,288,216 | A | | 12/1918 | Sayles |
| 2,625,205 | A | | 1/1953 | Holmes |
| 2,679,893 | A | | 6/1954 | Bennett |
| 3,138,402 | A | | 6/1964 | Heyl, Jr. et al. |
| 3,807,795 | A | | 4/1974 | Weant et al. |
| 4,249,774 | A | | 2/1981 | Andreasson |
| 4,387,876 | A | | 6/1983 | Nathan |
| 4,595,235 | A | | 6/1986 | Leib |
| 4,632,455 | A | | 12/1986 | Schiller et al. |
| 4,690,457 | A | | 9/1987 | Poncy et al. |
| 4,778,217 | A | * | 10/1988 | Lane ..... 297/DIG. 10 |
| 4,884,841 | A | * | 12/1989 | Holley ..... 297/344.16 |
| 4,907,303 | A | | 3/1990 | Baird |
| 4,929,022 | A | * | 5/1990 | Geraci ..... 297/313 |
| 4,946,222 | A | | 8/1990 | Matson |
| 5,011,224 | A | | 4/1991 | Paul |
| 5,094,508 | A | | 3/1992 | Bathrick et al. |
| 5,178,025 | A | * | 1/1993 | Bennett et al. ..... 297/DIG. 10 |
| 5,316,370 | A | | 5/1994 | Newman |
| 5,383,709 | A | | 1/1995 | Chaney et al. |
| 5,803,545 | A | | 9/1998 | Guguin |
| 5,884,935 | A | * | 3/1999 | Tholkes ..... 297/DIG. 10 |
| 5,984,338 | A | | 11/1999 | Meyer |
| 6,035,462 | A | | 3/2000 | Bennett et al. |
| 6,189,164 | B1 | | 2/2001 | Krapu |

* cited by examiner

*Primary Examiner*—Anthony D. Barfield
(74) *Attorney, Agent, or Firm*—Akin Gump Strauss Hauer & Feld, LLP

(57) ABSTRACT

A chair is operable between a seating position and a rise-assist position. The chair comprises a base; first and second legs; a seat pivotally connected to the first and second legs; and a back pivotally connected to the seat. The chair further comprises first and second members pivotally connected at a first end to the legs, and pivotally connected at a second end to the back. At least portions of the legs, first and second members, back and seat form first and second four-bar linkages, respectively. At least one biasing member is pivotally connected at a first end to one of the base and at least one of the legs and pivotally connected at a second end to at least one of the four-bar linkages. The at least one biasing member operates to assist movement of the chair between the seating position and the rise-assist position.

1 Claim, 7 Drawing Sheets

LIFT CHAIR

BACKGROUND OF THE INVENTION

This invention relates to the art of chairs and, more particularly, to a lift chair for assisting a user when moving between seated and standing positions.

Lift chairs are well known in the prior art. For example, U.S. Pat. No. 5,094,508 (Bathrick et al., hereinafter "Bathrick") discloses an elevator chair used to assist a user seated in the chair when moving to a standing position. More specifically, Bathrick discloses a lift chair having a first seated position (FIG. 2), wherein a back is substantially vertical and a seat is substantially horizontal, and a second, lift position (FIG. 3), wherein the back remains substantially vertical and a rear portion of the seat pivots upwardly relative to a front portion of the seat to assist the user in standing. Bathrick employs two four-bar mechanisms formed by members 30, 54, 61 and 24 and 31, 55, 61 and 25, respectively. Members 30 and 31 are telescoping. A drive tube 42 moves the back frame assembly 12 up and down, extending and retracting bars 30 and 31 within tubes 18 and 19. The seat 16 pivots as members 30 and 31 move up and down. Bathrick requires the use of relatively complex and expensive components, particularly the drive assembly 14 which includes an externally powered drive motor 40 and drive screw 41.

As a second example of a known lift chair invention, U.S. Pat. No. 3,807,795 (Weant et al., hereinafter "Weant") discloses a wheelchair having a motor-driven mechanism to move the chair seat, arms and back from a sitting position to a standing position. Weant discloses the seat 25, a lower portion of the back 31, the arms 41 and front arm supports 35 forming four bar linkages such that the seat 25 and arms 41 pivot forward and the back 31 remains generally upright as the chair moves from the seating position (FIG. 8) to the standing position (FIG. 9). Like Bathrick, Weant requires the use of relatively complex and expensive components.

In recognition of the limitations of the existing approaches, the present chair has been developed to provide a lift chair which is mechanically simple and inexpensive to manufacture.

BRIEF SUMMARY OF THE INVENTION

Briefly stated, the present invention is directed to a chair operable between a seating position and a rise-assist position. The chair comprises a base; first and second legs each having a first end connected to the base and a second end; a seat pivotally connected to the first and second legs; and a back pivotally connected to the seat. The chair further comprises first and second members each having a first end and a second end, the first ends of the first and second members being pivotally connected to the first and second legs, respectively, and the second ends of the first and second members being pivotally connected to the back. At least portions of the legs, first and second members, back and seat form first and second four-bar linkages, respectively. At least one biasing member is pivotally connected at a first end to one of the base and at least one of the legs and pivotally connected at a second end to at least one of the four-bar linkages. The at least one biasing member operates to assist movement of the chair between the seating position and the rise-assist position.

In a second aspect, the present invention is a chair operable between a seating position and a rise-assist position. The chair comprises a base; first and second legs each having a first end connected to the base and a second end; and first and second seat support members each having a first end and a second end, the first ends of the first and second seat support members being pivotally connected to the first and second legs, respectively, intermediate the first and second ends of the legs. A seat member extends between the first and second seat support members. First and second arm support members each have a first end and a second end, the first ends of the first and second arm support members being pivotally connected to the first and second legs, respectively, proximate the leg second ends. First and second back support members each have a first end and a second end, the first ends of the first and second back support members being pivotally connected proximate the second ends of the first and second seat support members, respectively, and intermediate the first and second back support member ends. The first and second back support members are pivotally connected to the first and second arm support members, respectively, proximate the second ends of the first and second arm support members. A back member extends between the first and second back support members. At least portions of the legs, arm support members, seat back members and seat support members form first and second four-bar linkages, respectively. At least one biasing member is pivotally connected at a first end to the base and pivotally connected at a second end to at least one of the four-bar linkages. The at least one biasing member operates to assist movement of the chair between the seating position and the rise-assist position.

In a third aspect, the present invention is a chair operable between a seating position and a rise-assist position. The chair comprises a frame, including a base, and first and second legs each having a first end connected to the base and a second end. The chair further comprises a seat having at least first, second, third and fourth sides defining first, second, third and fourth corners. The first and second corners are pivotally connected to the first and second legs, respectively. A back has at least first, second, third and fourth sides defining first, second, third and fourth corners, the first and second corners being pivotally connected to the third and fourth corners of the seat, respectively. First and second arm support members each have a first end and a second end, the first ends of the first and second arm support members being pivotally connected to the first and second legs, respectively, proximate the leg second ends and the second ends of the first and second arm support members being pivotally connected to the back. At least portions of the legs, arm support members, back and seat form first and second four-bar linkages, respectively. At least one biasing member is pivotally connected at a first end to at least one of the legs and pivotally connected at a second end to at least one of the four-bar linkages. The at least one biasing member operates to assist movement of the chair between the seating position and the rise-assist position.

In a fourth aspect, the invention is a chair operable between a seating position and a rise-assist position. The chair comprises a base; first and second legs each having a first end connected to the base and a second end; and first and second seat support members each having a first end and a second end, the first ends of the first and second seat support members being pivotally connected to the first and second legs, respectively, intermediate the first and second ends of the legs. A seat member extends between the first and second seat support members. First and second arm support members each have a first end and a second end, the first ends of the first and second arm support members being pivotally connected to the first and second legs, respectively, proximate the leg second ends. First and second back support members are pivotally connected to the first and second seat support members proximate the second ends of the first and second seat support members, respectively, and are further pivotally connected to the first and second arm support members, respectively, proximate the second ends of the first and second arm support members. A back member extending between the first and second back support members. At least portions of the legs, arm support members, seat back members and seat support members form first and second four-bar linkages, respectively. At least one biasing member is pivotally connected at a first end to one of the base and at least one of the legs and pivotally connected at a second end proximate the second end of at least one back support member. The at least one biasing member operates to assist movement of the chair between the seating position and the rise-assist position.

In a fifth aspect, the invention is a chair operable between a seating position and a rise-assist position. The chair comprises a base; first and second legs each having a first end connected to the base and a second end; first and second seat support members each having a first end and a second end, the first ends of the first and second seat support members being pivotally connected to the first and second legs, respectively, proximate the second ends of the legs; and a seat member extending between the first and second seat support members. First and second hand grip members each have a first end and a second end, the first ends of the first and second hand grip members being pivotally connected to the first and second legs, respectively, intermediate the first and second ends of the legs. First and second back support members each have a first end and a second end, the first ends of the first and second back support members being pivotally connected proximate the second ends of the first and second hand grip members, respectively, and intermediate the first and second back support member ends, the first and second back support members being pivotally connected to the first and second seat support members, respectively, proximate the second ends of the first and second seat support members. A back member extends between the first and second back support members. At least portions of the legs, hand grip members, seat back members and seat support members form first and second four-bar linkages, respectively. At least one biasing member is pivotally connected at a first end to one of the base and at least one of the legs and pivotally connected at a second end to at least one of the four-bar linkages. The at least one biasing member operates to assist movement of the chair between the seating position and the rise-assist position.

In a sixth aspect, the invention is a chair operable between a seating position and a rise-assist position. The chair comprises a base; and first and second leg supports each including: a first portion having a first end connected to the base and a second end, and a second portion having a first end connected proximate the second end of the first portion and a second end. At least one of the first portions further includes a biasing member having a first end extending from the first portion second end. First and second seat support members each have a first end and a second end, the first ends of the first and second seat support members being pivotally connected to the second portions of the first and second leg supports, respectively, intermediate the first and second ends of the second portions. A seat member extends between the first and second seat support members. First and second arm support members each have a first end and a second end, the first ends of the first and second arm support members being pivotally connected to the second portions of the first and second leg supports, respectively, proximate the second portion second ends. First and second back support members each have a first end and a second end, the first ends of the first and second back support members being pivotally connected proximate the second ends of the first and second seat support members, respectively, and intermediate the first and second back support member ends, the first and second back support members being pivotally connected to the first and second arm support members, respectively, proximate the second ends of the first and second arm support members. A back member extends between the first and second back support members. At least portions of the second portions of the leg supports, arm support members, seat back members and seat support members form first and second four-bar linkages, respectively. The at least one biasing member is pivotally connected at the first end to at least one of the four-bar linkages. The at least one biasing member operates to assist movement of the chair between the seating position and the rise-assist position.

In yet a seventh aspect, the invention is a chair operable between a seating position and a rise-assist position. The chair comprises a first frame including a base and first and second leg support members each having a first end connected to the base and a second end, each second end connected to a sleeve member. Each sleeve member further includes a pin member. The chair further comprises a second frame including third and fourth leg support members, each having a first portion adapted to be slidingly received within the sleeve members, the first portions having first and second ends and a plurality of adjustment holes adapted to releasably receive the pin member; and second portions having first and second ends. The first ends of the first portions are connected to the first ends of the second portions. Cooperation of the pin member and one of the plurality of adjustment holes allows the second frame to be releasably and adjustably fixed with respect to the first frame. First and second seat support members each have a first end and a second end, the first ends of the first and second seat support members being pivotally connected to the second portions of the third and fourth leg support members, respectively, intermediate the first and second ends of the second portions. A seat member extends between the first and second seat support members. First and second arm support members each have a first end and a second end, the first ends of the first and second arm support members being pivotally connected to the second portions of the third and fourth leg support members, respectively, proximate the second ends of the second portions. First and second back support members each have a first end and a second end, the first ends of the first and second back support members being pivotally connected proximate the second ends of the first and second seat support members, respectively, and intermediate the first and second back support member ends, the first and second back support members being pivotally connected to the first and second arm support members, respectively, proximate the second ends of the first and second arm support members. A back member extends between the first and second back support members. At least portions of the third and fourth leg members, arm support members, seat back members and seat support members form first and second four-bar linkages, respectively. At least one biasing member is pivotally connected at a first end to the base and pivotally connected at a second end to at least one of the four-bar linkages. The at least one biasing member operates to assist movement of the chair between the seating position and the rise-assist position.

BRIEF DESCRIPTION OF THE SEVERAL VIEWS OF THE DRAWINGS

The following detailed description of the preferred embodiments of the invention, will be better understood when read in conjunction with the appended drawings. For the purpose of illustrating the invention, there are shown in the drawings multiple embodiments which are presently preferred. It should be understood, however, that the invention is not limited to the precise arrangements and instrumentalities shown.

In the drawings.

DETAILED DESCRIPTION OF THE INVENTION

Figure 1:
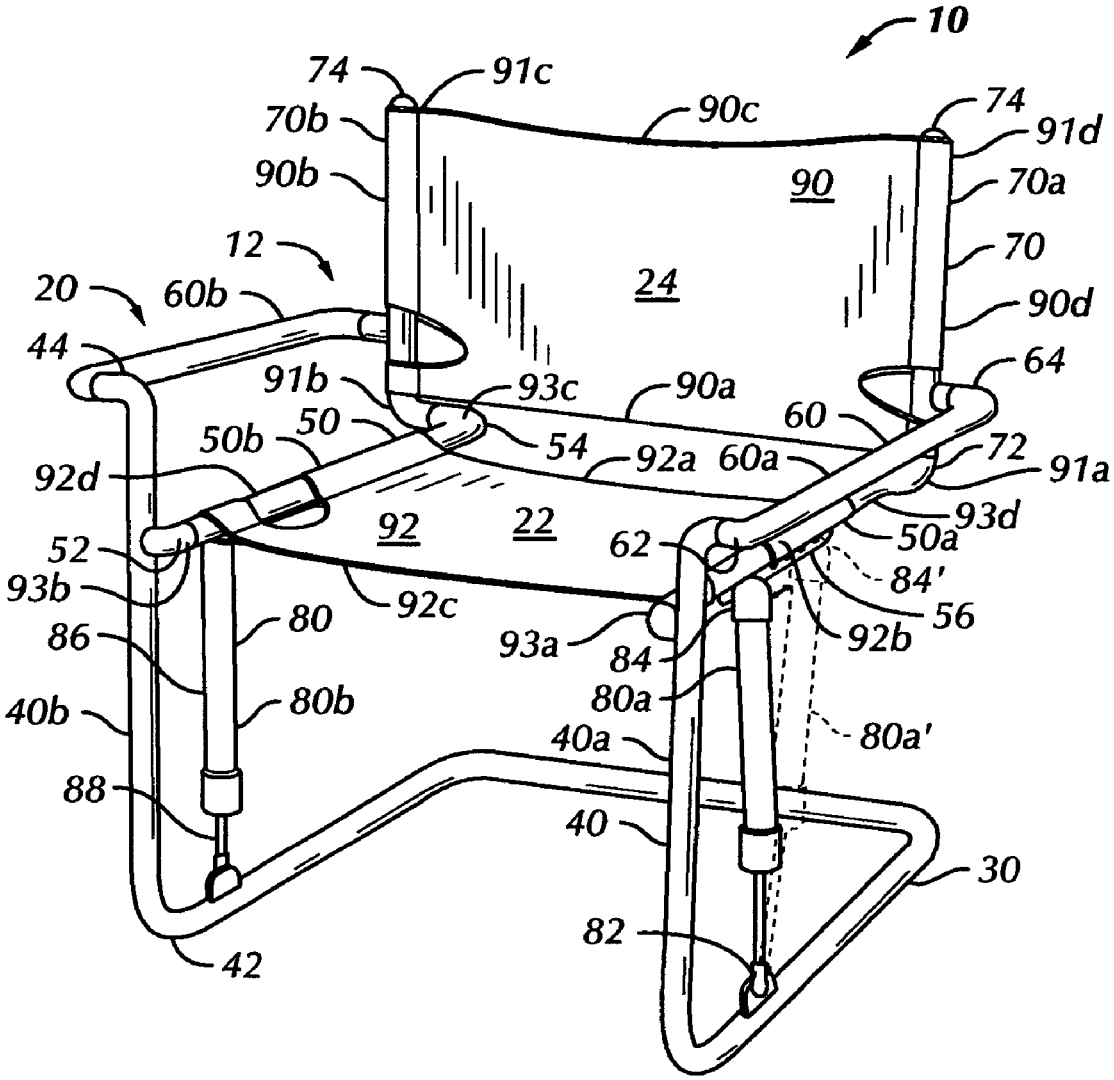
FIG. 1 is a front perspective view of a lift chair shown in a seating position in accordance with a preferred embodiment of the present invention.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the lift chair and designated parts thereof. The terminology includes the words above specifically mentioned, derivatives thereof and words of similar import.

Figure 2:
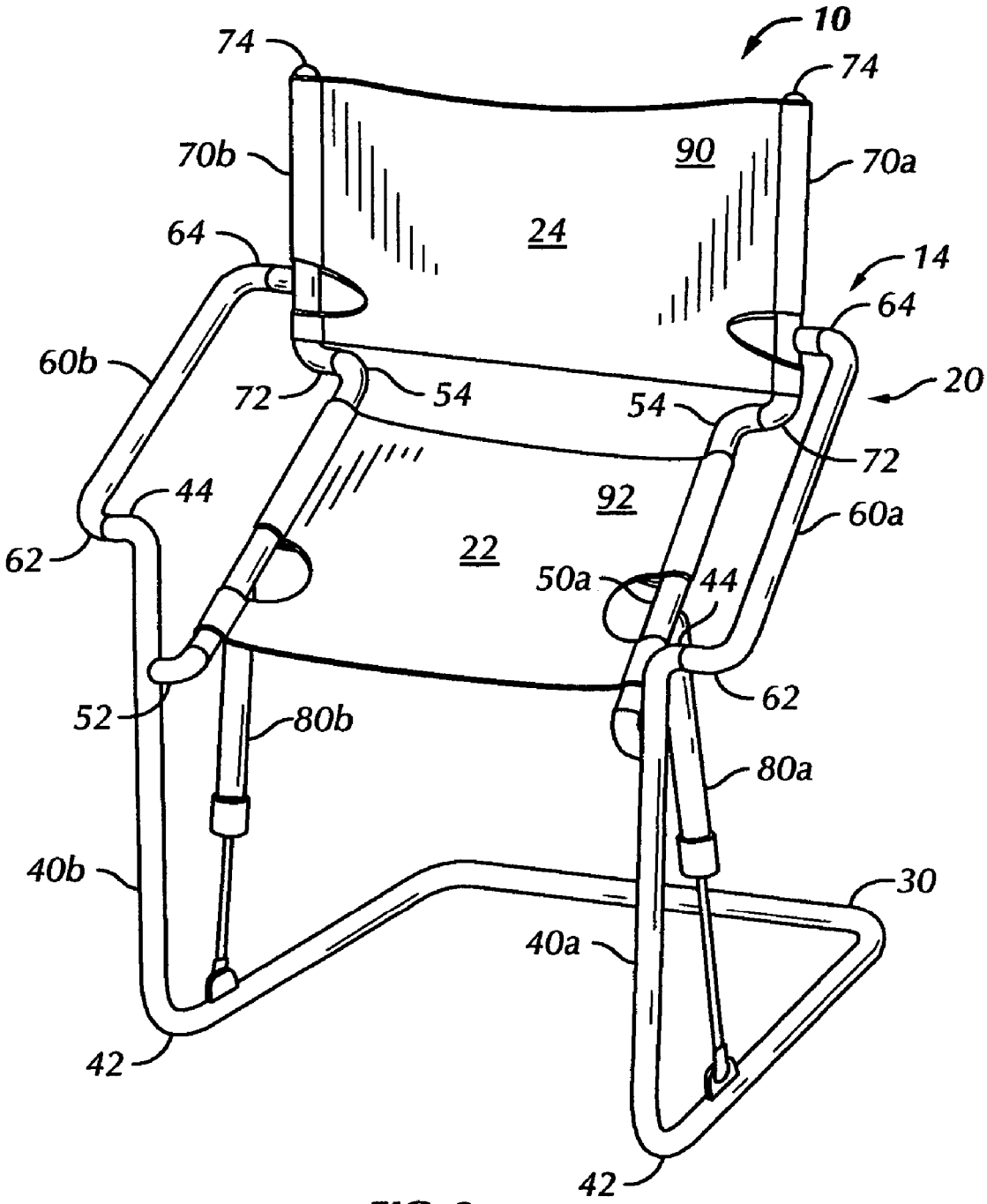
FIG. 2 is a front perspective view of the lift chair of FIG. 1 shown in a rise-assist position.

Referring to the figures, wherein like numerals are used to indicate like elements throughout, there are shown in FIGS. 1–7 multiple preferred embodiments of a lift chair in accordance with the present invention. With particular reference to FIGS. 1 and 2, a first preferred embodiment of a lift chair, generally designated 10, is illustrated. The lift chair 10 is movable between a seating position 12 (FIG. 1) and a rise-assist position 14 (FIG. 2). Major components of the lift chair 10 include a frame assembly 20, a seat 92, a back 90 and biasing members, preferably gas springs 80.

The frame assembly 20 includes a base 30, a pair of generally parallel front leg members 40, a pair of generally parallel seat support members 50, a pair of generally parallel arm support members 60 and a pair of back support members 70. The chair frame 20 is preferably fabricated from materials with high strength and low weight, such as certain woods (maple, oak), metals (steel, aluminum) or polymeric materials, or a combination thereof. The frame 20 is manufactured using conventional metal forming, wood forming or molding techniques well-known to those of ordinary skill in the art of chair manufacture. In a preferred embodiment, the frame assembly 20 is preferably fabricated from round metal tubing. The artisan will recognize from this disclosure that a wide variety of structural shapes, including, for example, rectangular solid shapes or square tubing shapes, could be substituted. The tubing configuration is particularly desirable in providing a structural member having a high strength to weight ratio.

The base 30 is preferably generally U-shaped, with an open portion of the U-shape facing toward the front of the chair 10. The artisan will recognize from this disclosure that a wide range of chair base designs could be employed, for example rocking chair rails (preferably interconnected at one or more points), H-shaped frames or A-shaped frames. The base 30 is stable while also allowing a user to easily slide his or her feet beneath the chair, increasing the comfort of the chair while the user is seated therein and also facilitating ease of sitting down into and rising from the chair 10. A first front member 40*a* and a second front member 40*b* extend generally vertically, each with a first end 42 and a second end 44. The front member first ends 42 connect to the base 30. In the embodiment illustrated in FIGS. 1 and 2, the front members 40 are formed integrally with the base 30, as a continuous metal tube forming the front members 40 and the base 30 is bent at an angle of about 90 degrees where the front members 40 join the base 30. From this disclosure, the artisan would recognize that the front members 40 could be separately formed from the base 30 and could be joined to the base 30 using a variety of techniques well known in the art of furniture manufacture, for example, a friction fit, welding or dove-tail grooves and adhesive.

The pair of seat support members 50 include a first seat support member 50*a* and a second seat support member 50*b*. The seat support members 50 extend generally horizontally and the seat support members 50 each have a first end 52 and a second end 54. The seat member 22 is supported between the first and second seat support members, 50*a* and 50*b*. The seat member 22 is preferably fabricated from conventional upholstery materials, for example leather, cotton or Nylon. The seat support members 50 pivotally connect to the front members 40 at a point intermediate the front member first and second ends 42, 44. The second ends of the seat support members 50 are preferably elbow-shaped, and fit for easy rotation within a mating receptacle (not clearly shown) in the front members 40. The artisan will recognize from this disclosure that a pivoting joint of any design meeting the criterion of easy rotation between mating members could be substituted for the elbow-shaped joints illustrated throughout the drawings.

The arm support members 60 include a first arm support member 60*a* and a second arm support member 60*b*. The arm support members 60 extend generally horizontally. Each of the arm support members 60 has a first end 62 and a second end 64. The arm support member first ends 62 are pivotally connected to the front members 40 proximate the front member second ends 44. The arm support member first ends 62 are generally elbow-shaped and fit for easy rotation with the similarly elbow-shaped second ends 44 of the front members 40. The arm support members 60 are shown in FIGS. 1 and 2 to be disposed laterally outwardly of the seat support members 50. From this disclosure, the artisan would recognize that the arm support members 60 and the seat support members 50 could be arranged to be more or to be less laterally aligned.

The back support members 70 include a first back support member 70*a* and a second back support member 70*b*. The back support members 70 are generally vertically oriented (for example, within 20 degrees of vertical), and each has a first end 72 and a second end 74. The back member 24 is supported between the first and second back support members 70 and is preferably made from the same material as the seat member 22. The seat support member second ends 54 are pivotally connected to the back support member first ends 72. In a preferred embodiment, the seat support member second ends 54 and the back support member first ends 72 are both elbow-shaped, and fit together for easy rotation. The arm support member second ends 64 are pivotally connected to the back support members 50 at a point intermediate the back support member first ends 72 and second ends 74. The arm support member second ends 64 are preferably elbow-shaped, and fit with receptacles in the back support members 70 for easy rotation.

Four-bar linkages are thus formed by members 40*a*, 50*a*, 60*a* and 70*a* and by members 40*b*, 50*b*, 60*b* and 70*b*. The four-bar linkage arrangement allows seat support members 50 and arm support members 60 to pivot relative to the front members 50 and back support members 70 such that a rear portion of the seat member 22 pivots upwardly of a front portion of the seat member 22, while the back member 24 remains in a substantially vertical orientation during the pivoting movement of the four-bar linkages. Rotating joints where the pivoting connections are made may incorporate internal stop members (not shown) which limit travel of the front members 40, seat support members 50, arm support members 60, and back support members 70 between the seating position 12 and the rise-assist position 14. Alternatively, the artisan would recognize that other methods could be employed to limit the range of travel of the chair 10. For example, the range of travel of the gas springs 80 could act to limit motion of the chair 10 between the seating position 12 and the rise-assist position 14, or external stops (not illustrated) could be used.

The biasing members are preferably gas springs 80 and preferably include a first gas spring 80*a* and a second gas spring 80*b*. Each gas spring 80 has a first end 82 and a second end 84. The gas springs 80 each include a cylinder portion 86 and a rod portion 88. The rod portion 88 extends from and retracts into the cylinder portion 86. The first ends 82 connect to the base 30, preferably using a clevis and pin arrangement. The second ends 84 connect to the seat support members 50, again preferably using a clevis joint. It will be understood that the gas springs 80 could be connected in some other orientation or to some other portion of the four bar linkages. Some of these alternative arrangements are illustrated in the additional embodiments discussed below. Preferably, the gas spring second ends 84 can be connected to the seat support members 50 at any given one of a plurality of connection points 56, permitting the position of the gas springs 80 to be adjustable relative to the seat members 50. For example, first gas spring 80*a* may be pivoted rearwardly and connected to seat support member 50*a* in position 80*a*', shown in phantom in FIG. 1. Alternatively, a connection between the second ends 84 and the seat support members 50 could allow re-positioning of the biasing members 80 along a continuum rather than at discrete points as illustrated with the plurality of connection points 56. The net moment acting on the seat support members 50 by the gas springs 80 is increased by positioning the gas springs 80 rearwardly, as the moment increases due to increase of the moment arm. By repositioning the gas springs 80 relative to the seat support members 50, the function of the gas springs 80 can be tailored for users of varying weights.

In use, the rod portion 88 is normally extended from the cylinder portion 86 of each gas spring 80 as shown in FIG. 2. In a typical gas spring such as the gas springs 80 employed in the present design, the cylinder portion 86 is pressurized with a gas. The rod portion 88 is connected to a piston (not shown) which moves within the cylinder 86. Both sides of the piston are exposed to the pressurized gas, however one side of the piston has a larger area exposed to the gas, and thus a net force acts on the piston. The net force acts to extend the rod 88 from the cylinder 86. An opposite and larger compressive force must thus be applied to push the rod portion 88 back into the cylinder portion 86. Thus, without a user sitting on the seat member 22 (or other weight placed on the seat member 22), the chair 10 is normally in the rise-assist position 14. When a user applies weight to the seat member 22 by sitting down, a moment due to the user's weight exceeds the opposing moment due to the biasing members, and the seat support members 50 tend to pivot in a clockwise direction (clockwise as seen in a left-hand view (left-hand from the perspective of an observer aft looking forward) as in FIGS. 1 and 2), the rod portions 88 are forced to retract within the cylinder portions 86, and the seat member 22 and arm support members 60 move from the rise-assist position 14 to the seating position 12, wherein the seat member 22 and arm support members 60 are substantially parallel to a horizontal surface upon which the chair 10 is supported. When the user desires to rise from the chair 10, the user leans forward, moving his or her center of gravity forward, thus reducing the moment due the user's weight, and the force of the gas pressure tends to extend the rod portions 88 and acts to push the seat member 22 back into the rise-assist position 14, reducing the effort required by the user to rise from the chair 10. Thus, the lift chair 10 operates to assist a user in both moving from a standing position into a seated position and vice versa.

While the biasing members have been disclosed to be gas springs, from this disclosure the artisan will recognize that other biasing members, for example metal coil springs, could be substituted.

The artisan will further recognize that a one piece rigid back 90 and/or seat 92 could be substituted for the construction described above. Such one piece backs 90 and seats 92 could be formed, for example, from rigid members having four sides, 90*a*–90*d* and 92*a*–92*d*, respectively, defining four corners 91*a*–91*d* and 93*a*–93*d*, respectively. In this alternative configuration, corners 93*a* and 93*b* would be pivotally connected to front legs 40*a* and 40*b*, respectively, while corners 93*c* and 91*b* and 93*d* and 91*a* would also be pivotally connected. The one piece back 90 and the one piece seat 92 could be fabricated from a plurality of materials conventionally used in furniture manufacture, including wood, metal, and polymeric materials, and fabricated using conventional manufacturing techniques well-known in the art of furniture manufacture.

Additional embodiments of the present invention are illustrated in FIGS. 3–7. Corresponding elements found in the various embodiments are similarly numbered, with a lead numeral of 1 through 5 (corresponding to the second through sixth embodiments, respectively) being added to the numbering scheme introduced relative to the first embodiment 10. For example, the base 30 of the first embodiment corresponds generally to the bases 130 through 530 of the second through sixth embodiments. Furthermore, each of these additional embodiments are shown in a seated position, similar to FIG. 1. For the sake of brevity, illustrations of these additional embodiments in the standing position, similar to FIG. 2, are omitted. Each of the additional embodiments is operable between the seated positions illustrated in FIGS. 3–7 and a rise-assist position similar to the rise-assist position 14 illustrated in FIG. 2

Figure 3:
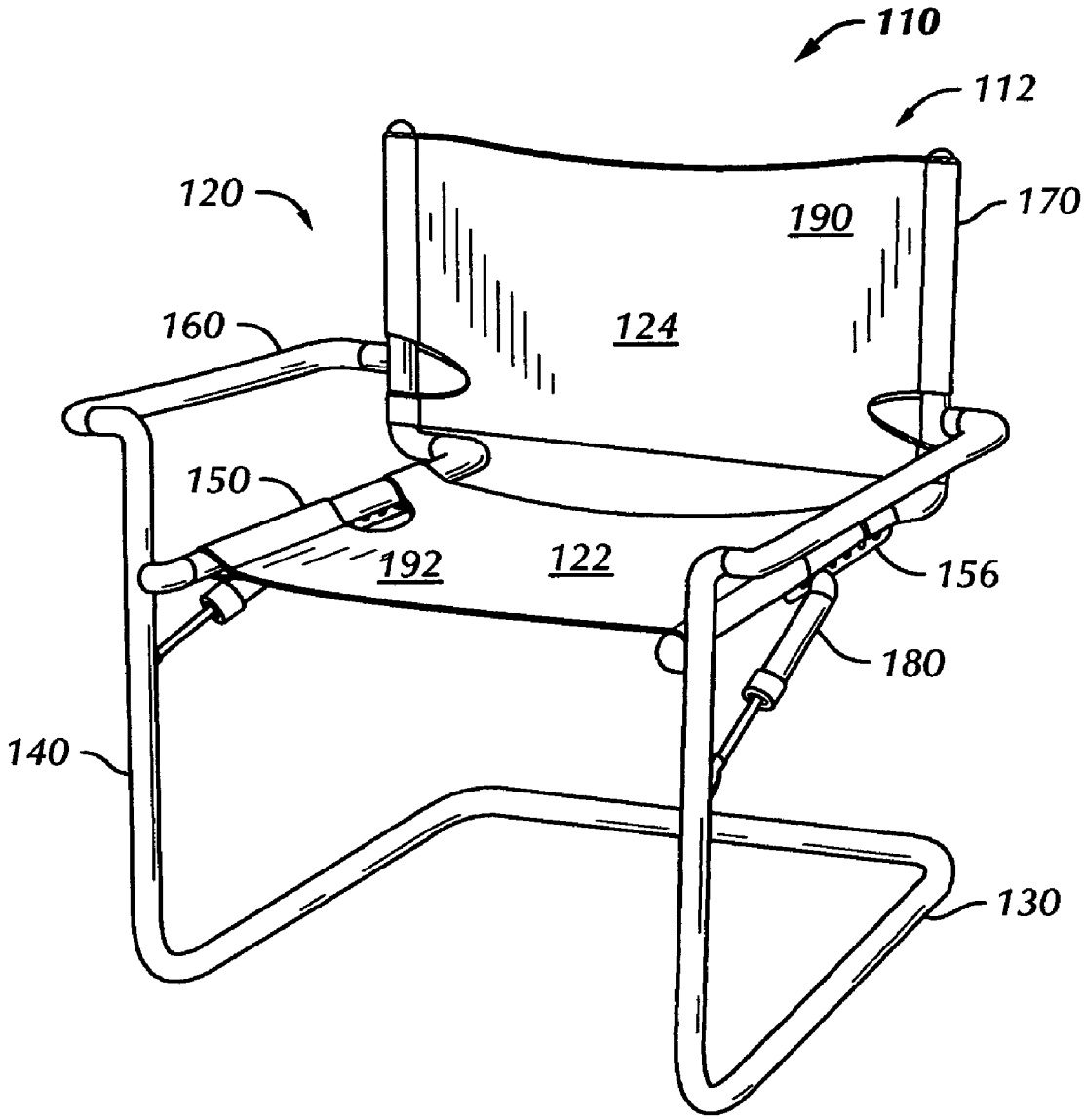
FIG. 3 is a front perspective view of a lift chair in accordance with a second preferred embodiment of the present invention.

With particular reference to FIG. 3, a second embodiment of the lift chair 110 is illustrated. The second embodiment is generally similar to the first embodiment 10, with the exception that the first ends of the gas springs 180 are connected to front legs 140 rather than being connected to a base 130 as in the first embodiment.

Figure 4:
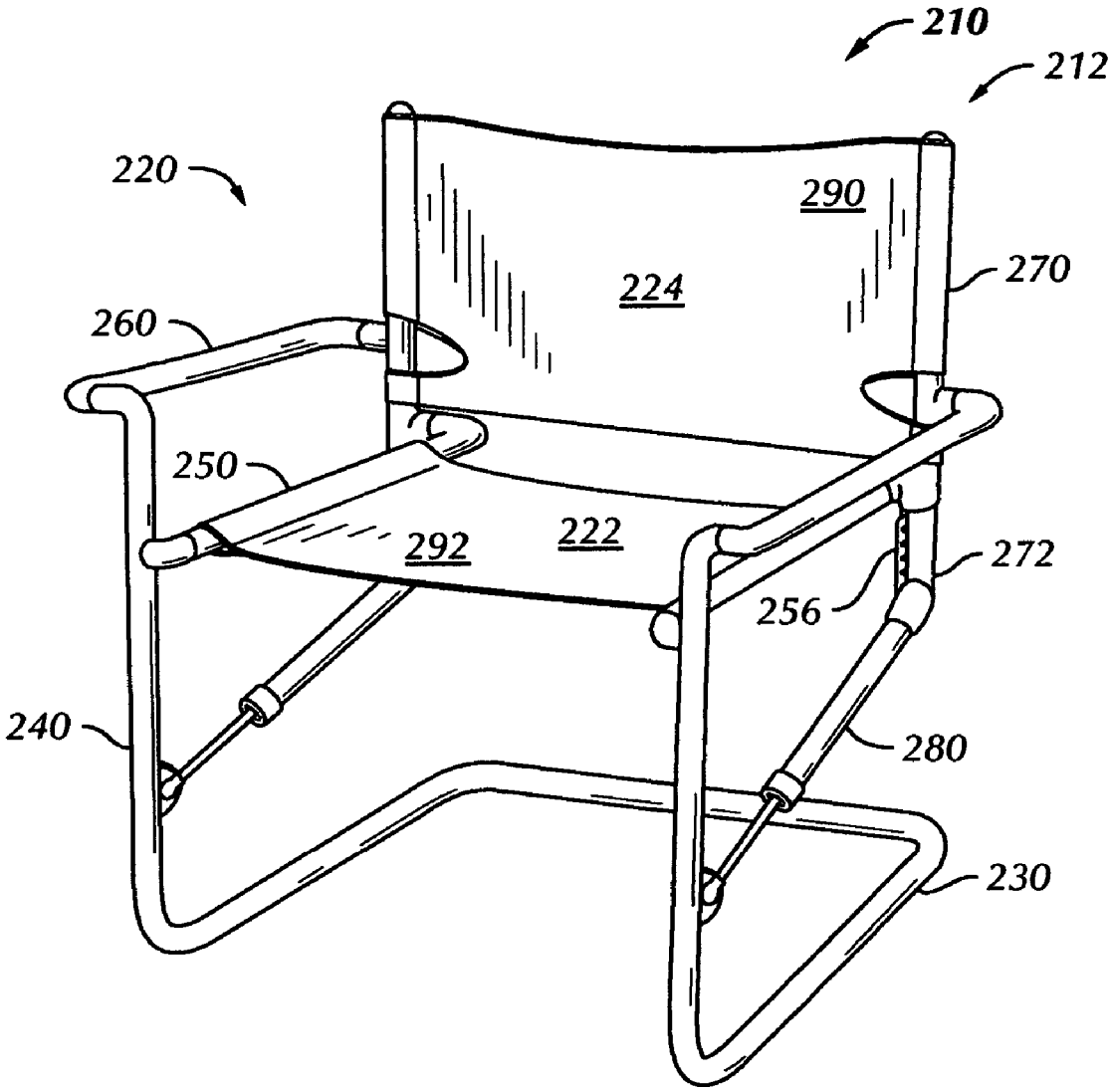
FIG. 4 is a front perspective view of a lift chair in accordance with a third preferred embodiment of the present invention.

With reference now to FIG. 4, a third embodiment of the lift chair, 210, is illustrated. In the third embodiment 210, back support members 270 are elongated relative to the first embodiment back support members 70, with the back support member first ends 272 extending below the seat 292. Biasing members 280 connect at a first end to leg members 240 and at a second end to the back support members 270 at back support member first ends 272.

Figure 5:
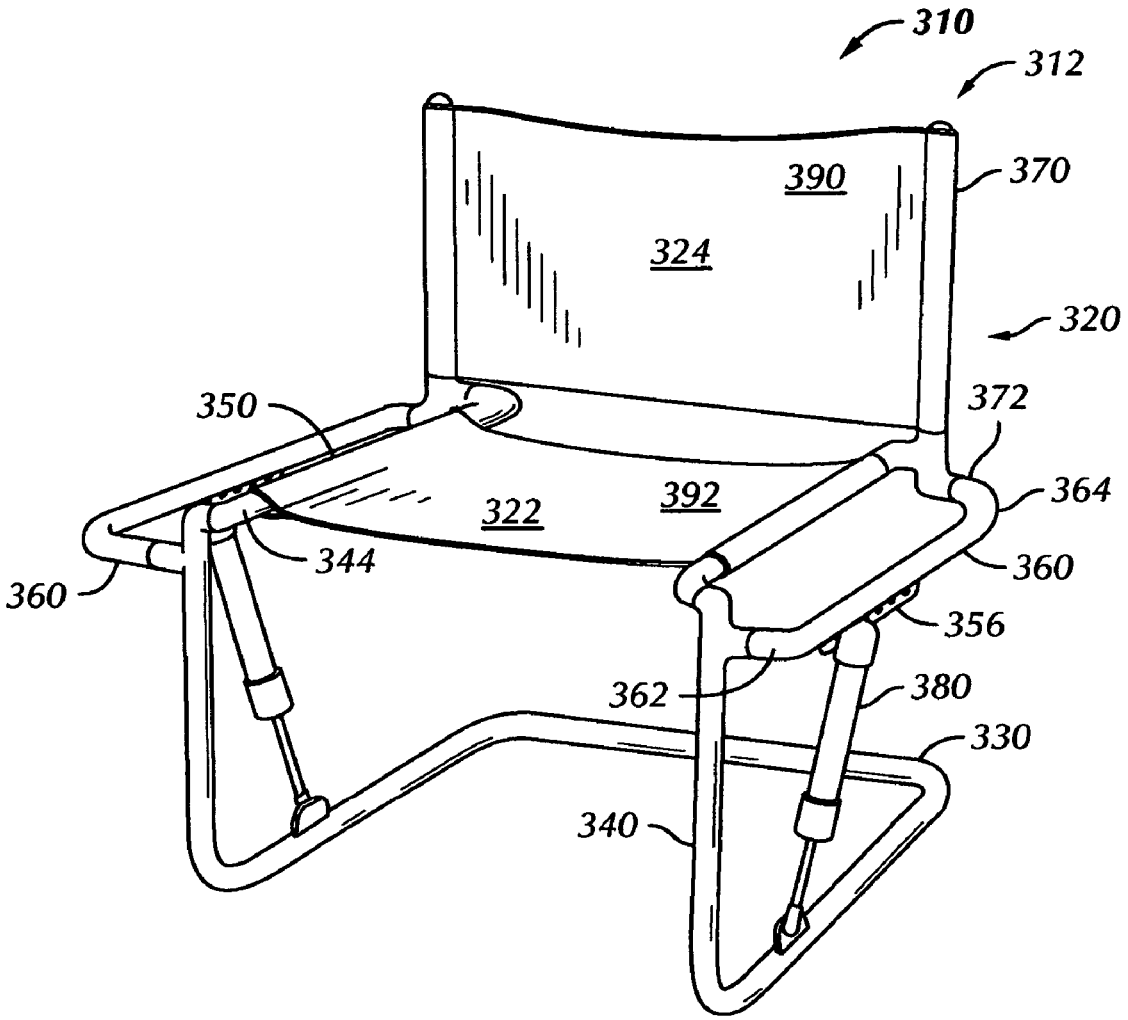
FIG. 5 is a front perspective view of a lift chair in accordance with a fourth preferred embodiment of the present invention.

With reference now to FIG. 5, a fourth embodiment of the lift chair, 310, is illustrated. In the fourth embodiment 310, hand grip members 360, corresponding generally to the arms 60 of the first embodiment, are located below seat support members 350. In the embodiment shown, the hand grip members are shown to be laterally exterior relative to the seat support members 350, thus providing the user with a convenient structural element to grasp and against which to push during a motion of rising from the chair 310. Alternatively, the hand grip members 360 could be located laterally interior to or immediately below the seat support members 350.

Figure 6:
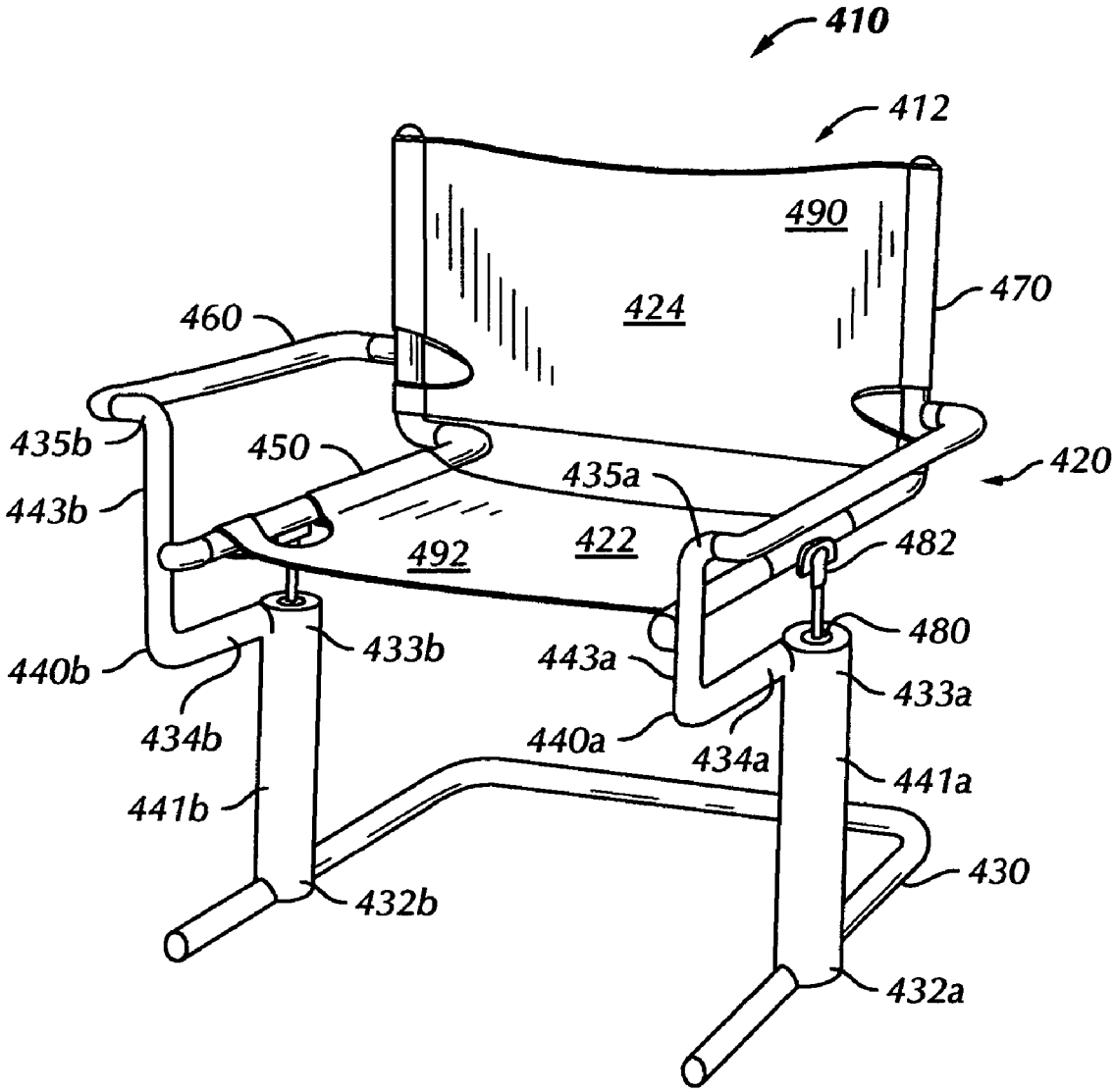
FIG. 6 is a front perspective view of a lift chair in accordance with a fifth preferred embodiment of the present invention.

With reference now to FIG. 6, a fifth embodiment of the lift chair, 410, is illustrated. In the fifth embodiment 410, the legs 40*a* and 40*b* of the first embodiment 10 are replaced with vertical supports 440*a* and 440*b* having first portions 441*a* and 441*b* and second portions 443*a* and 443*b*. The first portions 441*a*, 441*b* have first ends 432*a*, 432*b* and second ends 433*a*, 433*b*, respectively. Second portions 443*a*, 443*b* have first ends 434*a*, 434*b* and second ends 435*a*, 435*b*, respectively. First portions 441*a*, 441*b* rigidly connect to base 430 at first ends 432*a*, 432*b*. First portion second ends 433*a*, 433*b* connect to second portion first ends 434*a*, 434*b*, respectively. Second portion second ends 435*a*, 435*b* pivotally connect to arm members 460. Seat members 450 pivotally connect to the second portions 443*a*, 443*b* intermediate second portion first ends 434*a*, 434*b* and second ends 435*a*, 435*b*. Biasing members 480 are disposed within the first portions 441*a* and 441*b*, and pivotally connected at first ends 482 to seat members 450.

Figure 7:
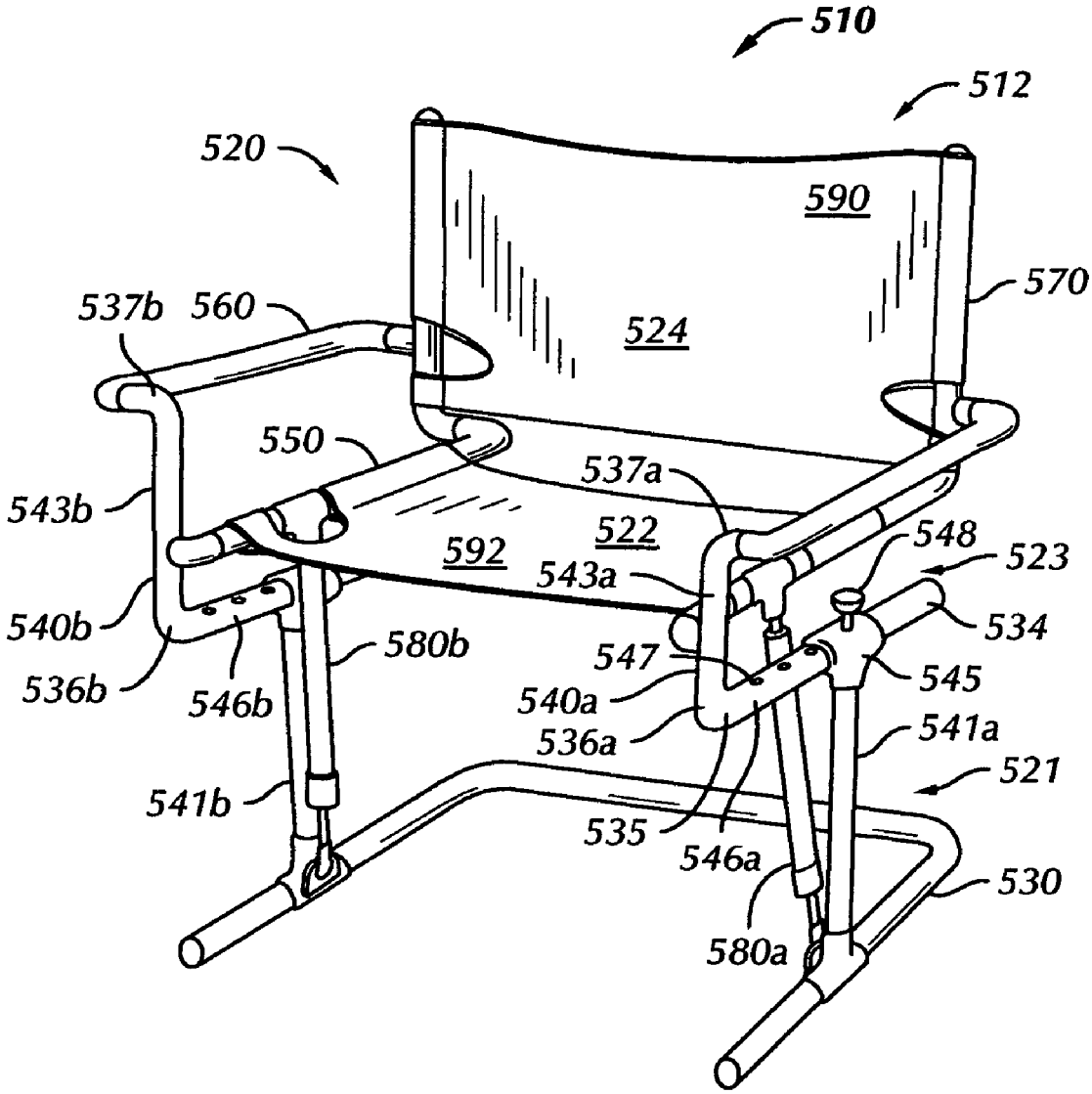
FIG. 7 is a front perspective view of a lift chair in accordance with a sixth preferred embodiment of the present invention.

With reference now to FIG. 7, a sixth embodiment of the lift chair, 510, is illustrated. In the sixth embodiment, a chair frame 520 comprises a first frame 521 and a second frame 523, the first and second frames 521, 523 being movable relative to one another. The first frame 521 comprises a base 530 and first and second leg support members 541*a*, 541*b*. The first and second leg support members 541*a*, 541*b* each have a first end connected to the base 530, and a second end connected to a sleeve member 545. Each sleeve member 545 includes a pin member 548. The second frame 523 comprises third and fourth leg support members 540*a*, 540*b*. The third and fourth leg support members 540*a*, 540*b* each have a first portion 546*a*, 546*b* adapted to be slidingly received within the sleeve members 545. The third and fourth leg first portions 546*a*, 546*b* each have first and second ends, 534, 535, as well as a plurality of adjustment holes 547 adapted to releasably receive the pin members 548. Third and fourth legs 540*a*, 540*b* further include second portions 543*a*, 543*b*, each having first and second ends 536*a*, 536*b* and 537*a*, 537*b*, respectively.

If pin members 548 are pulled out of engagement with one of the plurality of adjustment holes 547, the second frame 523 may be moved forward or rearward of the first frame 521, and the pin member 548 then released to re-engage with a second of the plurality of adjustment holes 547 to again fix the position of the second frame 523 relative to the first frame 521. By thus adjusting the position of the second frame 523 relative to gas springs 580*a*, 580*b*, the position of user's center of gravity is also moved relative to the gas springs 580*a*, 580*b*. As discussed above, position of the user's center of gravity relative to position of the point of application of the lifting force from the biasing members 580*a*, 580*b* is a parameter which influences the resultant force tending to drive the chair upward. Thus, a user may adjust the lifting force based on his or her weight, personal preference, or other factor.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

We claim:

1. A chair operable between a seating position and a rise-assist position, comprising:

a first frame including:

a base; and first and second leg support members each having a first end connected to the base and a second end, each second end connected to a sleeve member, each sleeve member further including a pin member;

a second frame including:

third and fourth leg support members, each having a first portion adapted to be slidingly received within the sleeve members, the first portions having first and second ends and a plurality of adjustment holes adapted to releasably receive the pin member, and second portions having first and second ends;

the first ends of the first portions being connected to the first ends of the second portions;

whereby cooperation of the pin member and one of the plurality of adjustment holes allows the second frame to be releasably and adjustably fixed with respect to the first frame;

first and second seat support members each having a first end and a second end, the first ends of the first and second seat support members being pivotally connected to the second portions of the third and fourth leg support members, respectively, intermediate the first and second ends of the second portions;

a seat member extending between the first and second seat support members;

first and second arm support members each having a first end and a second end, the first ends of the first and second arm support members being pivotally connected to the second portions of the third and fourth leg support members, respectively, proximate the second ends of the second portions;

first and second back support members each having a first end and a second end, the first ends of the first and second back support members being pivotally connected proximate the second ends of the first and second seat support members, respectively, and intermediate the first and second back support member ends, the first and second back support members being pivotally connected to the first and second arm support members, respectively, proximate the second ends of the first and second arm support members;

a back member extending between the first and second back support members;

at least portions of the third and fourth leg members, arm support members, seat back members and seat support members forming first and second four-bar linkages, respectively; and at least one biasing member pivotally connected at a first end to the base and pivotally connected at a second end to at least one of the four-bar linkages, whereby the at least one biasing member operates to assist movement of the chair between the seating position and the rise-assist position.

* * * * *